US007548630B2

(12) United States Patent
Schlenker et al.

(10) Patent No.: US 7,548,630 B2
(45) Date of Patent: Jun. 16, 2009

(54) INTEGRATED LOUDSPEAKER SYSTEM

(75) Inventors: Berthold Schlenker, Ilmenau (DE); Thomas Sporer, Fürth (DE); Karlheinz Brandenburg, Erlangen (DE)

(73) Assignee: Fraunhofer-Gesellschaft zur Forderung der angewandten Forshcung e.V., Munich (DE)

( * ) Notice: Subject to any disclaimer, the term of this patent is extended or adjusted under 35 U.S.C. 154(b) by 21 days.

(21) Appl. No.: 10/548,667

(22) PCT Filed: Mar. 11, 2004

(86) PCT No.: PCT/DE2004/000483

§ 371 (c)(1),
(2), (4) Date: Oct. 25, 2005

(87) PCT Pub. No.: WO2004/082320

PCT Pub. Date: Sep. 23, 2004

(65) Prior Publication Data

US 2006/0147074 A1 Jul. 6, 2006

(30) Foreign Application Priority Data

Mar. 11, 2003 (DE) ..... 103 10 532
Mar. 31, 2003 (DE) ..... 103 14 506

(51) Int. Cl.
*H04R 1/02* (2006.01)
*H04R 9/06* (2006.01)

(52) U.S. Cl. ..... 381/385; 381/120; 381/342; 381/161; 381/386; 381/395

(58) Field of Classification Search ..... 381/333, 381/87, 334, 152, 345, 162, 182, 374, 385–388, 381/394, 395, 423, 424, 431, 105, 107, 120, 381/161, 10, 17, 18, 300, 305, 80, 307; 369/99, 369/101, 126, 116, 44.11, 124.01, 44.29
See application file for complete search history.

(56) References Cited

U.S. PATENT DOCUMENTS

| | | | | |
|---|---|---|---|---|
| 3,992,586 | A | 11/1976 | Jaffe | |
| 4,593,404 | A | 6/1986 | Bolin | |
| 5,025,474 | A * | 6/1991 | Tanaka et al. | 381/333 |
| 6,098,743 | A | 8/2000 | McGrath | |
| 6,305,495 | B1 * | 10/2001 | Keegan | 181/290 |
| 7,162,730 | B1 * | 1/2007 | Ivie et al. | 725/78 |
| 2002/0027999 | A1 * | 3/2002 | Azima et al. | 381/431 |
| 2002/0106093 | A1 * | 8/2002 | Azima et al. | 381/111 |
| 2002/0191807 | A1 * | 12/2002 | Asada et al. | 381/335 |

(Continued)

FOREIGN PATENT DOCUMENTS

DE 199 22 395 C1 1/2001

(Continued)

*Primary Examiner*—Wayne R Young
*Assistant Examiner*—Dionne H Pendleton
(74) *Attorney, Agent, or Firm*—Breiner & Breiner, LLC

(57) ABSTRACT

A loudspeaker system including a plurality of sonic converters fixed in or to the rear of sound passage openings of a carrier plate is disclosed. The carrier plate is configured in the form of a wall plate for interior spaces or outside facades of buildings and the sonic converters are integrated into the carrier plate. The loudspeaker system or loudspeaker wall plate, respectively, permit the realization of an optimum acoustic irradiation of a space without aesthetically annoying loudspeaker boxes.

6 Claims, 5 Drawing Sheets

U.S. PATENT DOCUMENTS

| | | | | |
|---|---|---|---|---|
| 2003/0185404 | A1* | 10/2003 | Milsap | 381/77 |
| 2004/0223620 | A1* | 11/2004 | Horbach et al. | 381/59 |
| 2005/0097478 | A1* | 5/2005 | Killian et al. | 715/851 |

FOREIGN PATENT DOCUMENTS

| | | | |
|---|---|---|---|
| DE | 100 01 410 | A1 | 7/2001 |
| EP | 1 179 967 | A2 | 2/2002 |
| EP | 1 227 700 | A1 | 7/2002 |
| JP | 3-125598 | A | 5/1991 |
| WO | WO 96/28949 | | 9/1996 |

* cited by examiner

INTEGRATED LOUDSPEAKER SYSTEM

FIELD OF APPLICATION

The present invention relates to a loudspeaker system comprising several sonic converters that are fixed in or to the rear of sound passage openings in a carrier plate.

Loudspeaker systems are used both for private purposes and in the commercial sector in order to realise specific sound effects. Particularly the multichannel technology in the audio field requires the use of an ever-increasing number of loudspeakers. This confronts the user with ever-increasing problems in terms of arrangement and positioning of the loudspeakers because, as a rule, the aesthetic aspect of integration of the loudspeakers in the space plays an essential role.

PRIOR ART

For a reduction of these problems so far different approaches have become known. For example, picture-type loudspeakers are offered which can be fastened like a picture on a wall due to their flat design and their optical configuration. One disadvantage of such picture-type loudspeakers resides in the fact, however, that they cannot be consistently placed in such an arrangement as is demanded by the specification for the envisaged sound application. Moreover, the number of such picture-type loudspeakers, which may be accommodated in a room without impairment of the optical balance, is limited.

It is furthermore known to integrate loudspeakers in furniture doors so that they do not form separate objects in the room for the user. With this solution, too, the freedom of arrangement and the number of the individual loudspeakers is strongly limited, however.

The U.S. Pat. No. 4,593,404A describes a method of improving the acoustics in a hall, particularly for concert performance. In that method, wall elements with built-in loudspeakers, having a box-shaped structure, are mounted in the hall and ensure an appropriate additional acoustic irradiation. The wall elements are designed in a form comparable to that of conventional loudspeaker boxes, however without louvers, because the front panel of the wall elements serves to irradiate the sound directly.

The U.S. Pat. No. 3,992,586A discloses a sound amplification system for conference rooms, which, according to one embodiment, encompasses a loudspeaker system in a separate housing that is mounted on the ceiling. The loudspeakers in that loudspeaker system are disposed behind sound passage openings of the housing.

The German Patent DE 100 01 410 A1 describes a flat loudspeaker system including several plate-shaped loudspeakers that may be applied in seamless succession like tiles on the wall of a room. In this manner, one can obtain an areacovering wall cover which constitutes the flat loudspeaker system.

Eventually, the German Patent DE 199 22 395 C1 discloses a ceiling element having the function of a ceiling loudspeaker. The ceiling element consists of a plate-shaped component including a converter, which constitute a plate-shaped loudspeaker, with the plate-shaped component being maintained in a biased condition by means of a box-shaped tensioning means that serves also for suspension of the ceiling element. The loudspeaker is used with the tensioning device directly as ceiling element.

The problem underlying the present invention consists in providing a loudspeaker system that offers higher freedom in terms of the number and the arrangement of the individual sonic converters, without impairment of the aesthetic impression of the room where the loudspeaker system is used.

BRIEF DESCRIPTION OF THE INVENTION

The problem is solved by the loudspeaker system according to Patent claim 1. Expedient embodiments of the loudspeaker system are the subject matters of the dependent claims or may be derived from the description given below and from the embodiments.

The present loudspeaker system consists of a plurality of sonic converters in a manner known per se, which are fixed in or behind sound passage openings of a carrier plate. The present loudspeaker system excels itself by the provision that the carrier plate is configured as wall panel for interior rooms or outside facades of buildings and that the sonic converters are integrated into the carrier plate so that they do not project beyond the rear side of the carrier plate. Any known types whatsoever of loudspeakers such as dome loudspeakers or flat loudspeakers may be used as sonic converters.

The loudspeaker wall plate formed in this manner, which consists at least of the wall plate with the sound passage openings and the sonic converters, combines audio technology with building technology. The loudspeaker wall plate is mounted in interior-construction techniques on a substructure made of metal, wood or similar materials, as is also the case in known wall plates for interior spaces, which consist, as a rule, of gypsum plasterboard. The present loudspeaker wall plate may be used not only for the erection of new walls but may also be applied on existing walls. The room may be exclusively clad with or formed by such loudspeaker wall plates may comprise only in parts such loudspeaker wall plates at the desired locations. A room clad with or erected in such a manner with one or several loudspeaker wall plates may hence include a multi-channel audio reproduction system directly already, without the necessity to place separate loudspeaker boxes in the room.

Even if the preferred embodiment of the present loudspeaker system provides wall plates for the interior spaces in buildings as supporting plates it is, of course, equally possible to use suitable wall panels for exterior facades on buildings as supporting panels in order to permit the sonic irradiation of a region outside and in front of a building. The loudspeaker wall plates are then used as outside cladding of the building.

The present loudspeaker system, which is or will also be referred to as loudspeaker wall plate in the preceding sections and hereinbelow, is mainly employed in event halls, in cinemas and at home (living room, TV room). The wall plate preferably presents dimensions of at least 250×60 cm (height×width) so that it can be easily used for usual room heights.

The wall plate is covered preferably over its entire surface by an optically attractive film or an optically attractive tissue on its face side so that the individual sonic converters of the wall plate remain invisible. They are a constituent of the walls constituting the room. In the present loudspeaker system, the cables of the individual sonic converters are placed on the rear side of the wall plate so that this cabling, too, remains invisible to the user. The present loudspeaker system may be expediently employed for the reproduction of sonic sources after wave field synthesis as a minimum of six loudspeakers per meter of wall width can be integrated into the wall plate without any problems. With this configuration, too, the aesthetic overall impression of the room is not impaired by the use of the present loudspeaker system as all sonic converters are integrated into the walls of the room and remain invisible to the user in the preferred configuration.

In a preferred configuration of the present wall plate also the required audio amplifiers in analogy and digital technology are integrated into the wall plate or mounted on the rear side thereof, together with all the necessary means for controlling the individual sonic converters. In this configuration, hence only the connectors for the supply of the appropriate audio data, e.g. of a multi-media system or a CD or DVD player with digital pre-amplifier, to the amplifiers are still required.

The wall plates are preferably processed on the front-side surface in such a way that they can be placed as wall elements or may be applied on existing walls as additional cladding, both without any further final processing. This may be achieved, for instance, also by the use of the aforementioned film or tissue. A final treatment like in case of gypsum plasterboard is not required in such a case. This results in substantially shorter installation periods, with a shortening of the wall panels to different room heights being possible at any time. Different surfaces, i.e. surfaces in various designs and colours, may, of course, be offered in order to satisfy the user's demands. The transportation and the storage of such wall plates are equally simple because these wall plates can be stacked without any problems.

The present loudspeaker system or the present wall plate, respectively, will be briefly explained again in the following, with reference to embodiments in combinations with the drawings. In the drawings.

WAYS OF REALISING THE INVENTION

Figure 1:
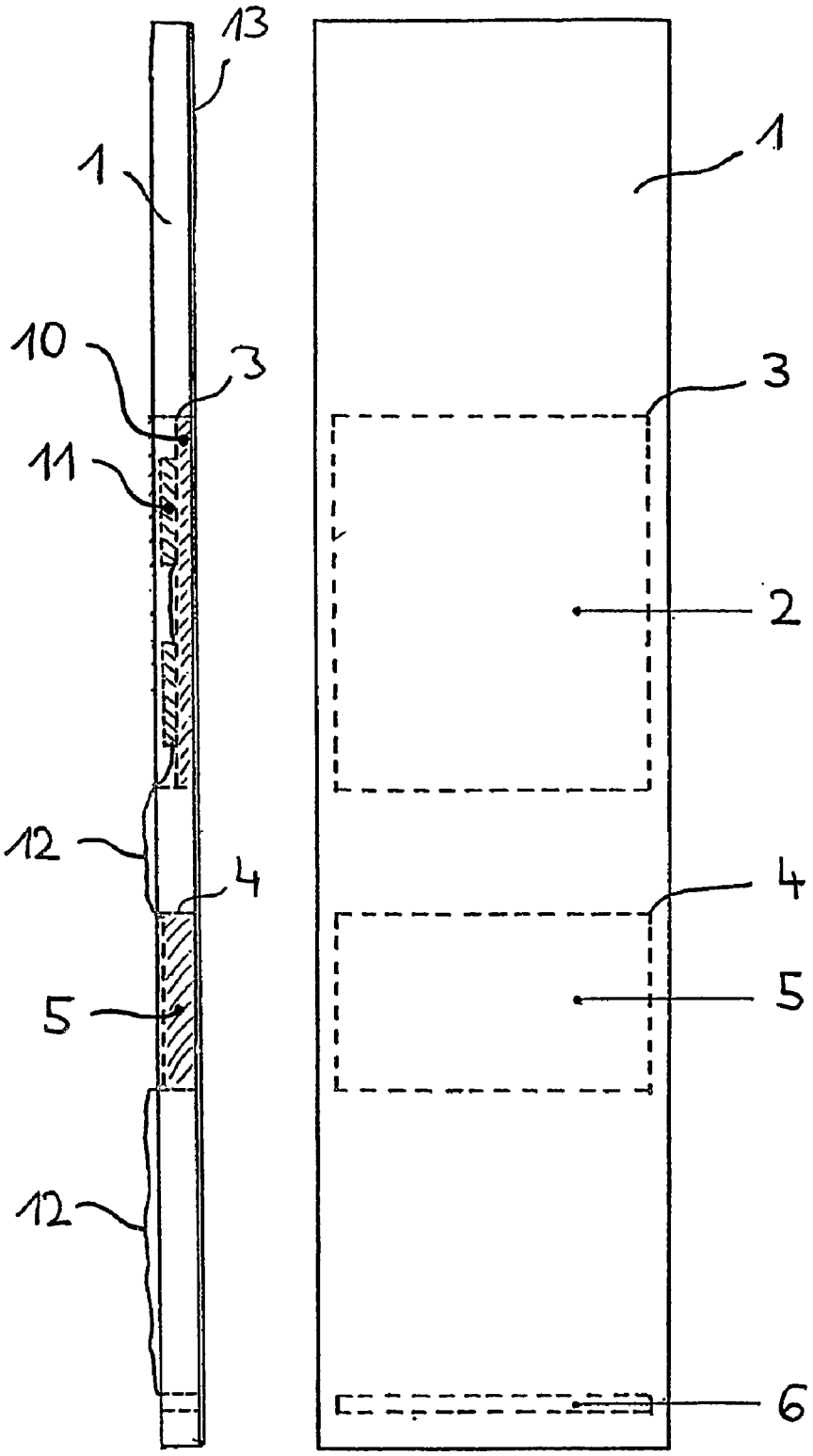
FIG. 1 illustrates a first example of a loudspeaker wall plate.

FIG. 1 illustrates an exemplary loudspeaker wall plate in accordance with the present invention, having the dimensions of a gypsum plasterboard of 60×260 cm (width×height) and, when seen from above and from the side, having a thickness of 25 mm. A rectangular recess is formed as sound passage opening in this wall plate 1, into which an array of sonic converters in DML technology (DML: Distributed Mode Loudspeaker) is inserted. In the present example, this array of sonic converters 2 consists of a special sandwich board 10 having the dimensions of 65×50 cm at a thickness of approximately 7 mm, on which four exciters 11 of the Elac company are mounted by means of an adhesive agent. The board 10 is adhesively bonded into the corresponding sound passage opening 3 of the wall plate 1. The side view illustrates also the film 13 applied on the face side as well as the cabling 12 on the rear side, even though in a strongly schematic form.

An amplifier system 5 consisting of digital amplifiers and an electronic control system are mounted on the rear side underneath the sound passage opening 3, which electronic system is mounted by means of an aluminium sheet into the respective rectangular recess 4 of the wall plate 1. The electronic control system is equipped with DSPs and has the function of appropriately processing the data supplied via a data line (cable 12) and the digital amplifiers. In the present example, the data flow between the electronic control system and the digital amplifiers is realised in compliance with the common $I^2S$ specification.

A connection panel 6 can be seen below the amplifier system 4, via which the data arrives at the amplifier system. In the present example, the data flow from an intelligent audio system to the electronic control system is realised in correspondence with the fire-wire specification. The supply line and the fire-wire data line are passed out up to the connector panel 6.

On principle, the wall plate 1 may consist of different materials, e.g. chipboard or MDF (medium-density fibre board) both in the present example and in the embodiments described below. It is possible to use commercially available boards or panels as original material from which the wall plate 1 with the required recesses or sound passage openings for the sonic converters 2, the amplifier 5 and the connector panel 6 can be produced by sawing and/or milling. The wall plate with the respective recesses or sound passage openings may also be specifically produced with a suitable jig and/or a tool configured to this end in a pressing or casting process. For attenuation of reflections, the wall play may also be provided additionally with a regular array or raster of holes.

Figure 2:
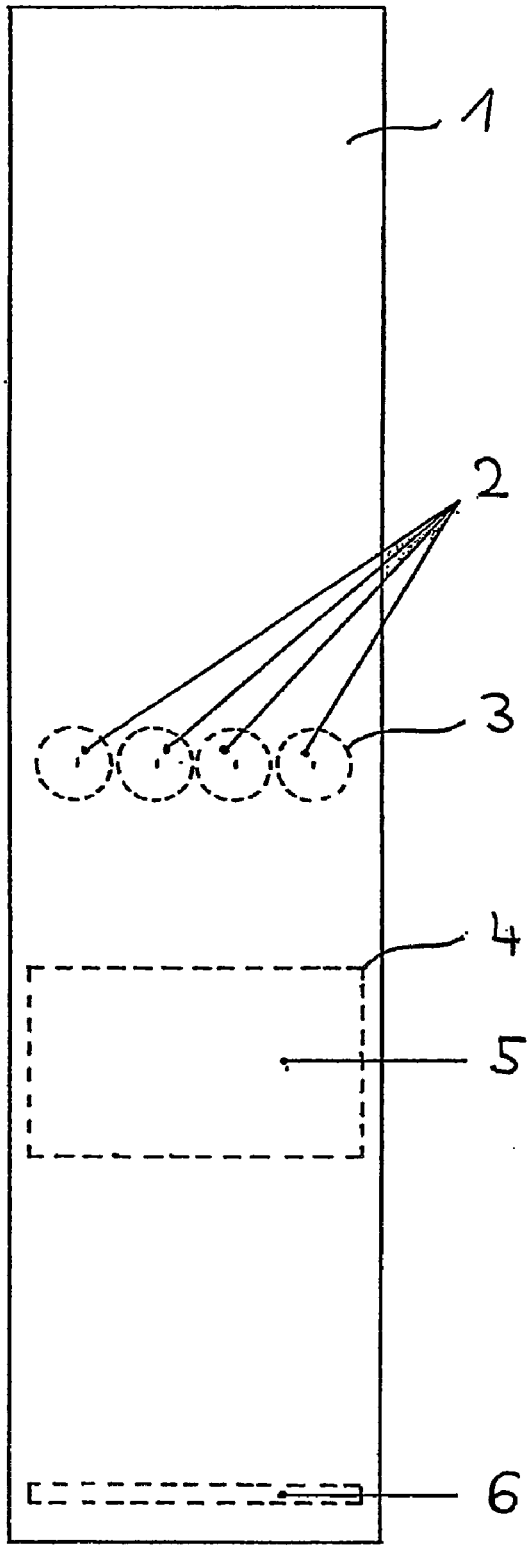
FIG. 2 shows a second example of a loudspeaker wall plate.

It is possible to use, for instance, conventional diaphragm-type loudspeakers or even loudspeakers in DML technology as sonic converters 2, as is the case in the embodiment according to FIG. 1. FIG. 2 illustrates an example wherein sound passage openings 3 are formed in the wall plate 1 for four conventional loudspeakers. The four loudspeakers may be inserted into the respective recesses of the sound passage openings 3 in a wall plate 1 having a width of 60 cm and a cage diameter up to roughly 13 cm. The further configuration of FIG. 2 corresponds to that according to FIG. 1 already explained. It is, of course, also possible to realise wall plates 1 having other dimensions, for instance a double width of 120 cm, in which case the double number of sonic converters 2 is preferably disposed in juxtaposition.

Figure 3:
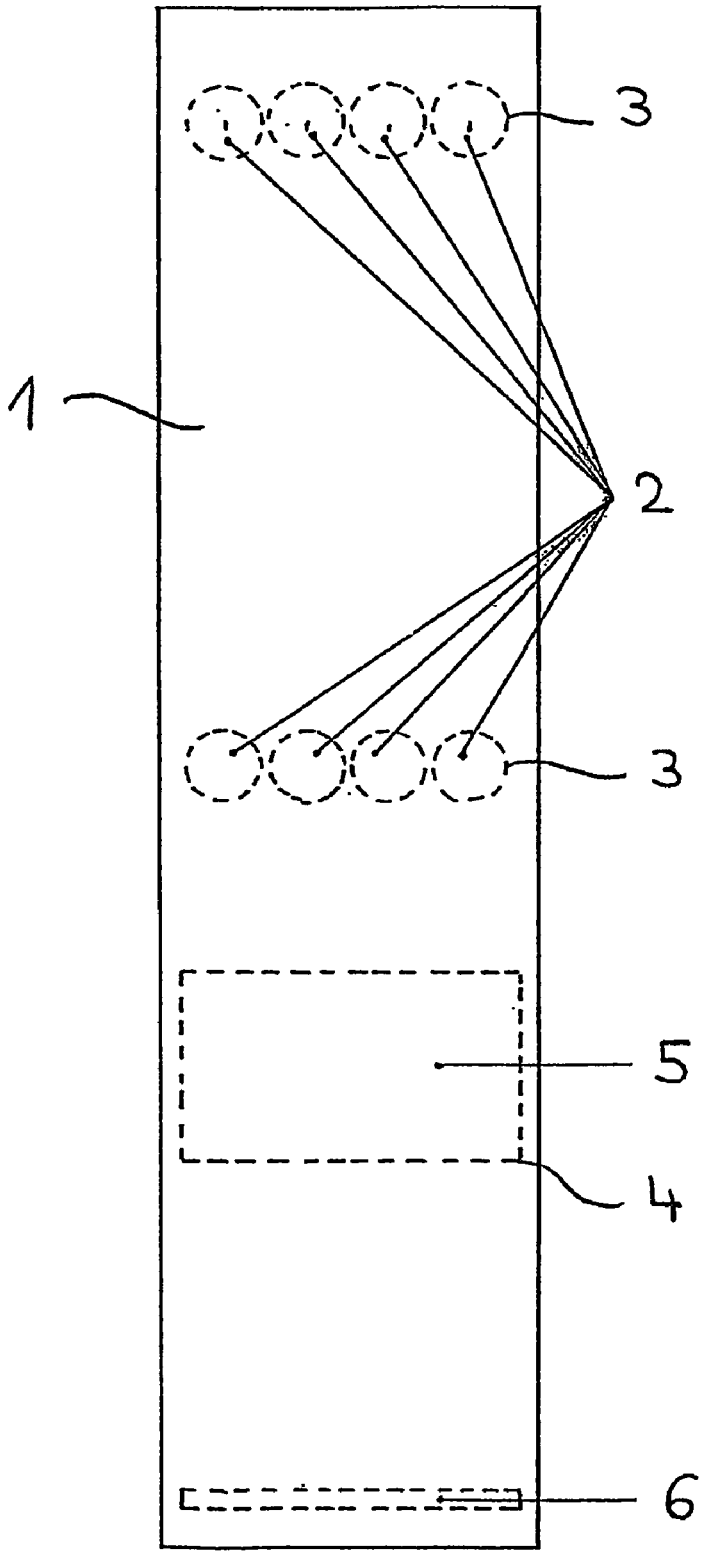
FIG. 3 is a view of a third example of a loudspeaker wall plate.
Figure 4:
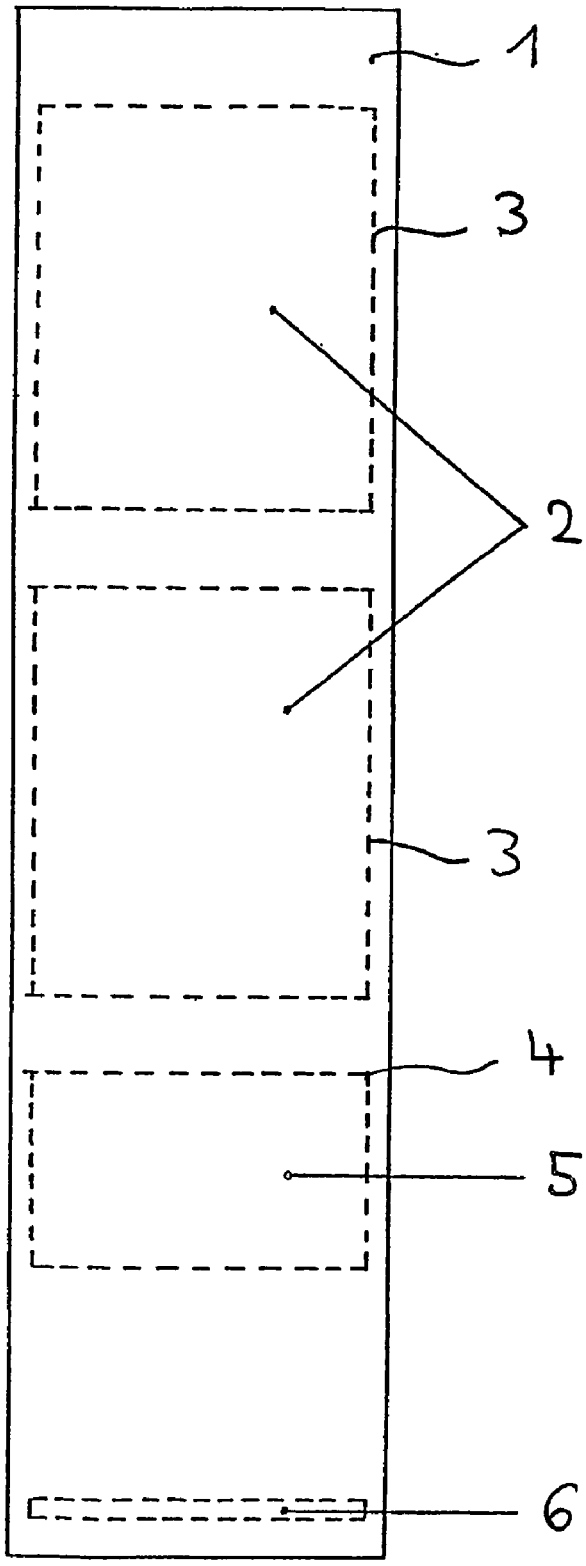
FIG. 4 shows a fourth example of a loudspeaker wall plate.

Each of the further FIGS. 3 and 4, too, illustrates comparable configurations wherein, however, two respective loudspeaker arrays are integrated into the wall plate 1, with conventional loudspeakers in FIG. 4 and with loudspeakers in DML technology in FIG. 4.

In all the embodiments illustrated here, the surface of the wall plate 1 is provided with an aesthetically agreeable film tissue (film 13, FIG. 1) that may be applied in different colours and structures. This cannot be recognised in the individual figures.

For the installation of the illustrated wall plates 1 for the erection of a wall delimiting a space, first of all the metal structure of a supporting wall is placed, in a manner known per se, and the hollow volume is then filled with insulating boards, e.g. made of mineral wool. The loudspeaker wall plates 1 are then screwed by means of quick-action building screws on the support sections. To this end, the bores provided in the loudspeaker wall plate are used. The joints may be adhesively closed by means of a decorative strip supplied along with the board. For adaptation, blank boards, i.e. wall plates not equipped with sonic converters and amplifiers, are used in the region of windows, doors and corners, which are made of the same material and present the same optical impression. All fastening screws and/or fastening anchors are covered by caps or strips.

A loop is laid for voltage supply. The amplifiers are connected via insulation piercing connectors to this loop. The supply voltage is 24 VDC and is made available by a power supply block and is applied, for instance, at the intelligent audio system. The fire-wire data line is looped from the loudspeaker wall plate to another loudspeaker wall plate. The skirting board is mounted after installation of the voltage supply and application of the supply voltage and connection of the data line. Subsequently, the operation of the loudspeaker system can be started.

When the present wall plates are mounted on existing brickwork, vertical wood strips are mounted on the brickwork by means of stop dowels, on which the wall plates are then fastened.

Figure 5:
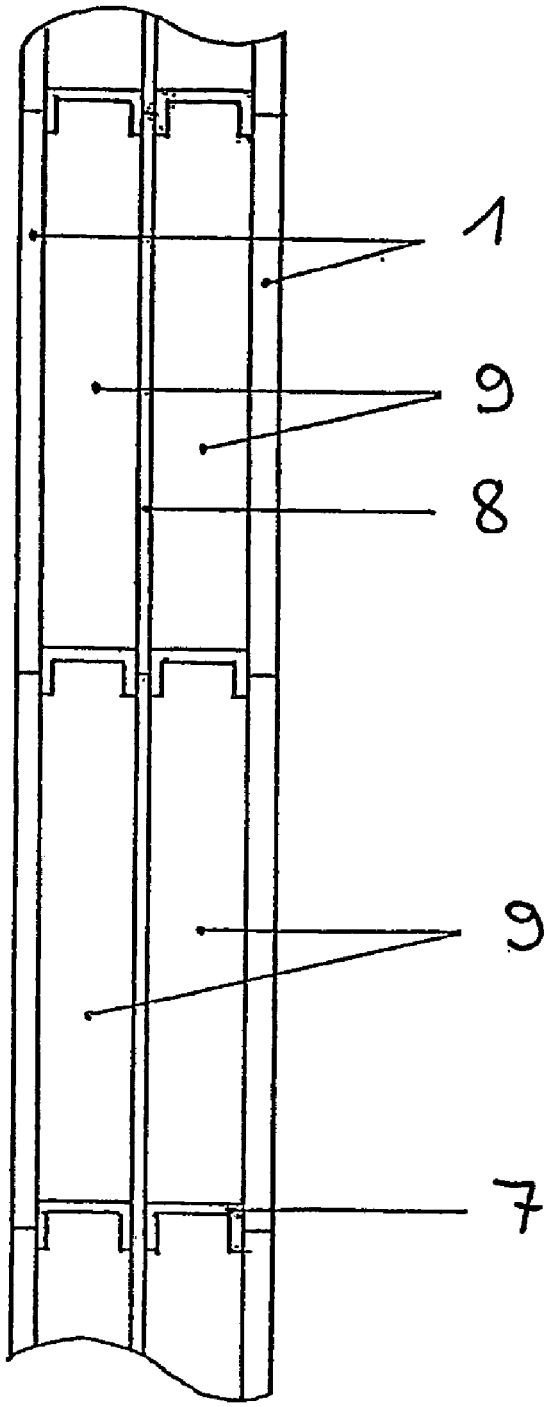
FIG. 5 illustrates an example of a partitioning between two adjacent rooms where inventive loudspeaker wall plates are installed.

When two neighbouring rooms are equipped with the present loudspeaker wall plate 1 it is necessary to erect a dual supporting wall for acoustic decoupling, as is illustrated in an exemplary side view in FIG. 5. Then the present loudspeaker wall plates 1 are screwed onto either side of the section 7 of the dual supporting wall, as has been described above already. A gypsum plasterboard 8 forms the centre of the dual supporting wall. Appropriate insulating boards 9 are inserted between the gypsum plasterboard 8 and the loudspeaker wall plates 1.

The present loudspeaker wall plate is particularly configured for the direct use in interior-construction techniques so that it may be mounted on supporting walls or on existing walls in a manner similar to the mounting of gypsum plasterboard. The cavity of the supporting wall is used as operating volume for the loudspeakers or sonic converters, respectively. A reduction of the length to the given height of the room is possible at any time. The present loudspeaker system or the present loudspeaker wall plate, respectively, hence combines audio technology with building technology. The loudspeakers are invisible, as a rule, because they are integrated into the wall and covered by a film or a thin tissue. The wall plate is preferably finished already so that trowelling, grinding, painting or paperhanging is not required in this case. Cabling and wiring of the individual wall elements is possible after completion due to the connector panel. Cabling may by covered, in a manner known per se, by a skirting board or a decorative strip. Storage and transportation of the loudspeaker plate are simple because the plates are easy to stack on each other. Individualised packing like that of loudspeaker boxes is hence omitted. The system consists of a base plate, a sonic converter, preferably an amplifier, surface finishing and possibly the installation means. The loudspeaker system is particularly well suited also for the so-called wave field synthesis, without interfering with the aesthetic impression of the room in which it is installed.

| LIST OF REFERENCE NUMERALS | |
|---|---|
| 1 | wall plate |
| 2 | sonic converters |
| 3 | sound passage openings |
| 4 | recess for amplifier |
| 5 | amplifier system |
| 6 | connection panel |
| 7 | support section |
| 8 | gypsum plasterboard |
| 9 | insulating board |
| 10 | special sandwich board |
| 11 | exciter |
| 12 | cable |
| 13 | film/tissue |

The invention claimed is:

1. Loudspeaker system comprising a plurality of sonic converters, each of said sonic converters having a separate membrane and being integrated with sound passage openings of a carrier plate, said carrier plate being constructed and arranged as a wall plate for an interior space or exterior facade of a building, wherein a minimum of six of said sonic converters per meter of wall width is integrated into said carrier plate, wherein said sonic converters are disposed in said carrier plate and connected to at least one audio amplifier and an electronic control system with DSPs for said at least one audio amplifier for reproduction after wave field synthesis, or for multi-channel reproduction, or for reproduction after wave field synthesis and for multi-channel reproduction, said at least one audio amplifier being disposed on a rear side or in one or more recesses of said wall plate.

2. Loudspeaker system according to claim 1, wherein said wall plate has dimensions of at least 250 cm in height and at least 60 cm in width.

3. Loudspeaker system according to claim 1, wherein said wall plate is covered by a film or a tissue on a face side thereof.

4. Loudspeaker system according to claim 2, wherein said wall plate is covered by a film or a tissue on a face side thereof.

5. Loudspeaker system according to claim 1, further comprising a connector panel formed on a face side of said wall plate for connection of the loudspeaker system.

6. Loudspeaker system according to claim 1, wherein at least one said wall plate with said sonic converters comprise at least one interior wall of an interior space.

* * * * *